US006592237B1

(12) United States Patent
Pledger

(10) Patent No.: US 6,592,237 B1
(45) Date of Patent: Jul. 15, 2003

(54) PANEL FRAME TO DRAW AIR AROUND LIGHT FIXTURES

(76) Inventor: John M. Pledger, 370 Hope Dr., Dallas, GA (US) 30157

( * ) Notice: Subject to any disclaimer, the term of this patent is extended or adjusted under 35 U.S.C. 154(b) by 0 days.

(21) Appl. No.: 10/026,545

(22) Filed: Dec. 27, 2001

(51) Int. Cl.[7] ..... F21V 29/00

(52) U.S. Cl. ..... 362/147; 362/373; 362/362

(58) Field of Search ..... 362/147, 148, 362/373, 294, 217, 362, 404, 364, 365

(56) References Cited

U.S. PATENT DOCUMENTS 3,701,895 A * 10/1972 Sweetser ..... 362/147
3,838,268 A * 9/1974 Fabbri ..... 362/147
3,949,533 A 4/1976 Spencer et al.
4,171,535 A 10/1979 Westermann
4,449,166 A 5/1984 Sharp
4,729,074 A 3/1988 Steadman
5,613,759 A 3/1997 Ludwig et al.
5,809,730 A 9/1998 Renz
5,823,663 A * 10/1998 Bell et al. ..... 362/362
6,210,025 B1 * 4/2001 Schmidt et al. ..... 362/362
6,286,980 B1 * 9/2001 Meyer ..... 362/365

* cited by examiner

*Primary Examiner*—Thomas M. Sember
(74) *Attorney, Agent, or Firm*—Richard C. Litman

(57) ABSTRACT

An add-on panel frame to draw air around ceiling light fixtures, by lowering the transparent panel to allow the circulation of air around the illumination source. The frame parts are supplied as four linear pieces which can be carried to the site in a slim box and combined at the site.

5 Claims, 7 Drawing Sheets

PANEL FRAME TO DRAW AIR AROUND LIGHT FIXTURES

BACKGROUND OF THE INVENTION

1. Field of the Invention

The present invention relates generally to light fixture systems. More specifically, the invention is a metal frame that fits a conventional ceiling grid. The frame raises the height of the light fixture from its cover and allows air to be drawn around the light, but maintains the same appearance.

2. Description of the Related Art

The related art of interest describes various light fixture systems, but none discloses the present invention. There is a need to extend the life of the lights by circulating air in a ceiling fixture with an inexpensive addition to increase the life of an incandescent or fluorescent light, and yet maintain the same appearance of the fixture. The relevant art will be discussed in the order of perceived relevance to the present invention.

U.S. Pat. No. 4,171,535 issued on Oct. 16, 1979, to Winfried N. Westermann describes a luminaire for concealed inverted "T" bar ceiling systems comprising a rectangular opening on the sides of the hinged and latched door frame for entrance of air and longitudinal vents in the ceiling of the frame. The device is distinguishable for employing only longitudinal exhaust vents in the top of the frame and entrance openings on the bottom sides by the hinged and latched door frame.

U.S. Pat. No. 3,949,533 issued on Apr. 13, 1976, to William H. Spencer et al. describes a vented modular ceiling system combined with a fluorescent lighting and ventilating facility. T-shaped aluminum stringers are interlocked and support acoustical tiles. Air is distributed by plenum chambers to ventilate a portion of the lighting fixtures, but does not actually enter the lighting fixture. This system is distinguishable for not circulating air directly to the light fixture and by utilizing an external circulating air system.

U.S. Pat. No. 4,449,166 issued on May 15, 1976, to Joseph F. Sharp describes a lighting fixture and air flow support system comprising a manufactured ceiling fixture having a surrounding frame with air forced through an upper opening and passing vertically downward and discharged through a lower opening in the frame. On an opposite side of the lighting fixture, air from the room enters a lower opening and is discharged into the space above the fixture through an upper opening of the frame. The system is distinguishable for forming vents in the lighting fixture frame as an original manufactured product.

U.S. Pat. No. 5,809,730 issued on Sep. 22, 1998, to Manfred Renz describes a mounting system for elaborate mounting filter-fan units in a clean room in a grid structure that provide receiving openings for the filter-fan units. The system is distinguishable for requiring specialized ceiling filtering fan units.

U.S. Pat. No. 4,729,074 issued on Mar. 1, 1988, to Earl J. Steadman describes a ceiling frame for a lighting fixture in a plaster board panel. The ceiling frame is distinguishable for being inserted in plaster board panels without any air circulation.

U.S. Pat. No. 5,613,759 issued on Mar. 25, 1997, to Craig S. Ludwig et al. describes a ceiling structure for retaining light fixtures and air filter panels, having a grid of interconnected rails, hanger hooks and pivoting wall headers. The system is distinguishable for not providing air circulation for the light fixtures.

None of the above inventions and patents, taken either singularly or in combination, is seen to describe the instant invention as claimed. Thus, an apertured panel frame to draw air around light fixtures solving the aforementioned problems is desired.

SUMMARY OF THE INVENTION

The invention is directed to a metal frame that fits in a conventional ceiling grid. The frame raises the light fixture from its cover and allows air to be drawn around the light. The frame is constructed in four pieces that snap together at the corners for rapid assembly. The frame is made of a light metal and rests on the ceiling grip where the light fixture normally rests. The light fixture sits on top of the frame, and the lens of the lens of the light fixture is removed and placed in the frame at a lower position which is closer to the conventional position of the lens. Air is allowed to circulate around the light fixture while the same appearance of the conventional light fixture is maintained.

Accordingly, it is a principal object of the invention to provide an add-on kit to modify a conventional ceiling light fixture for maintaining air circulation.

It is another object of the invention to provide another frame to lower the lens.

It is a further object of the invention to provide another frame which is easy to assemble and attach to the conventional ceiling light fixture.

Still another object of the invention is to provide another lowered frame to leave a space for enabling the continuous circulation of cooling air through the ceiling light fixture.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to an add-on frame for a conventional ceiling light fixture employing fluorescent lights. The object of this invention is to extend the life of an incandescent lamp or a fluorescent lamp in a ceiling light fixture which may employ a plurality of lamps to multiply the effect of the heat generated by the lamps during use. The circulation of air around illuminated lamps decrease the heat created in the conventional ceiling light fixture having a removable lens. Heat generated by a lit lamp travels by conduction and convection of the heated air within the light fixture. The conventional housing does not have adequate ventilation ducts to allow the hot air to pass out, so there is a need to promote the circulation of the hot air to exit the hot fixture as effluent air. Therefore, an extension frame which has vents would allow the hot air to flow out as effluent air, and cause the influx of cooler room air to enter as influent air to maintain a lower temperature within the housing to increase the lifetime of the lamps.

Figure 1:
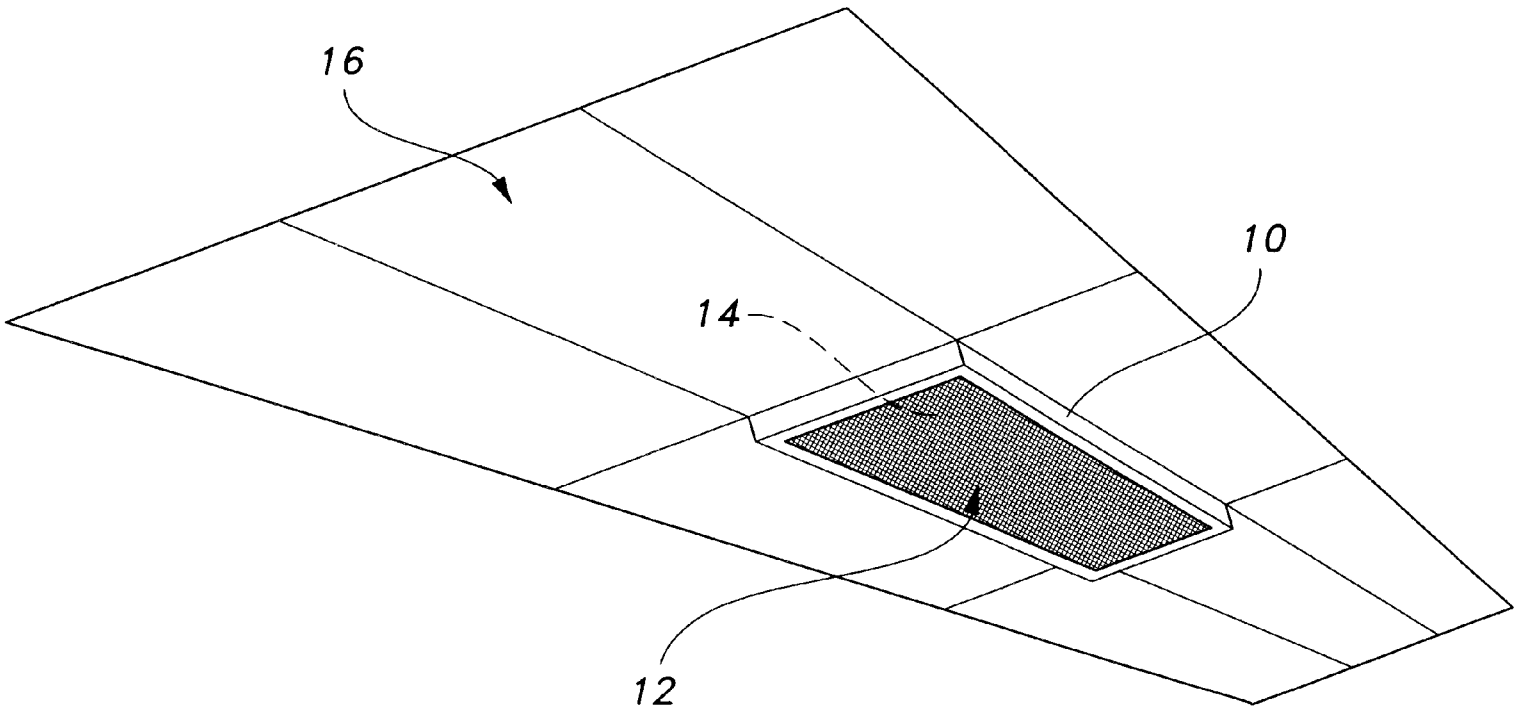
FIG. 1 is an environmental, perspective view of a modified ceiling panel to draw air around light fixtures according to the present invention.
Figure 2:
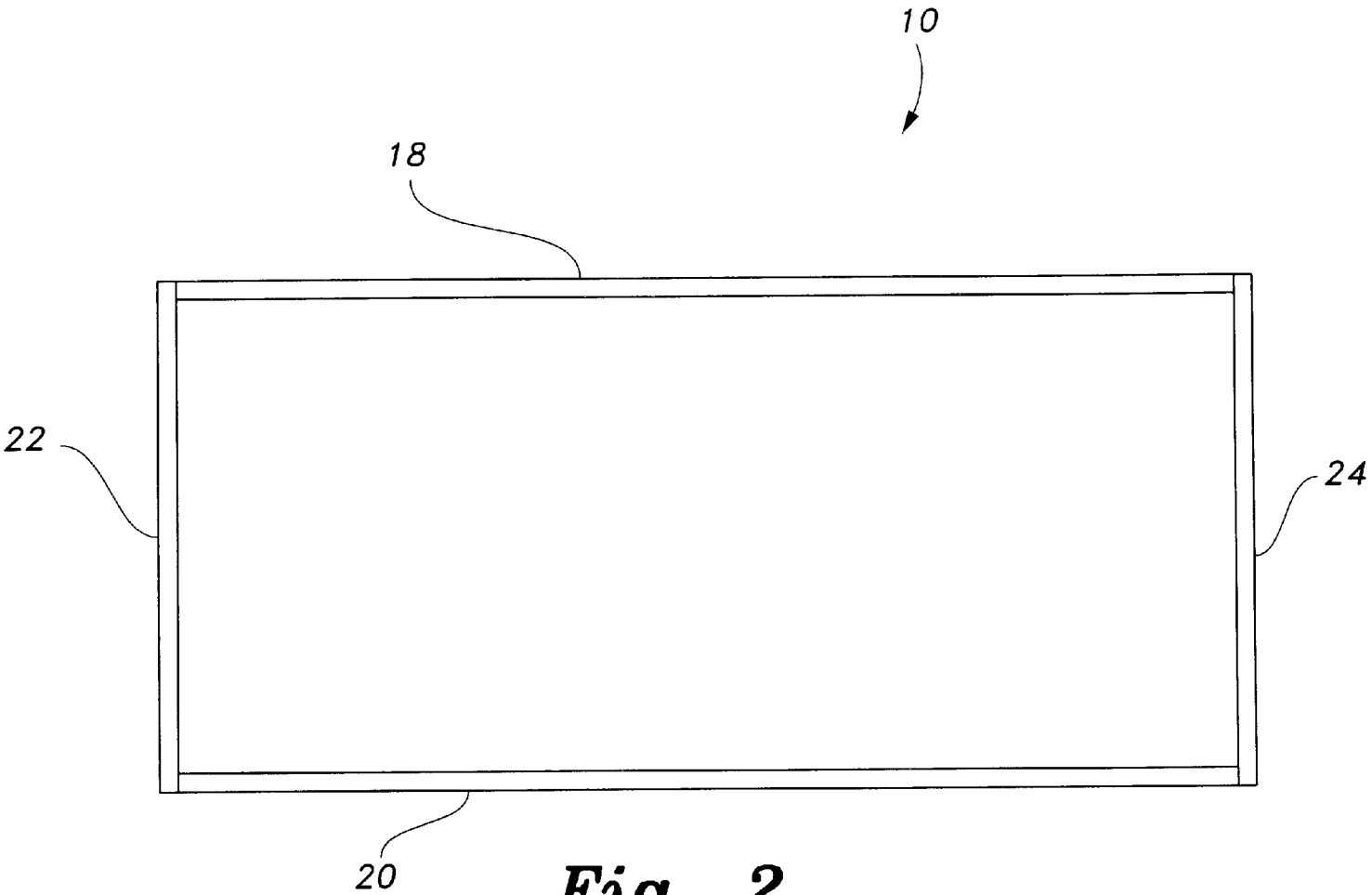
FIG. 2 is a plan view of a complete metal frame.
Figure 3:
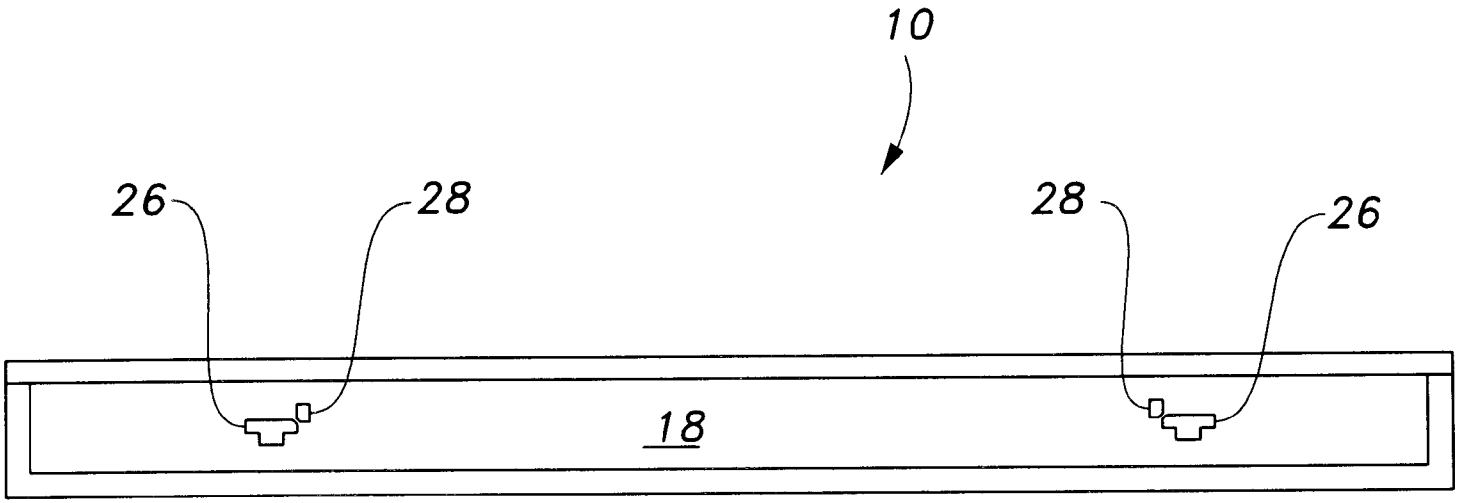
FIG. 3 is an inside elevational view of one length portion of the frame.
Figure 4:
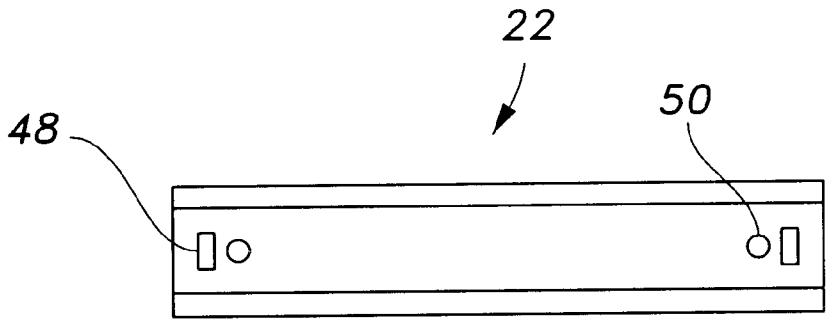
FIG. 4 is an inside elevational view of one short width portion of the frame.
Figure 5:
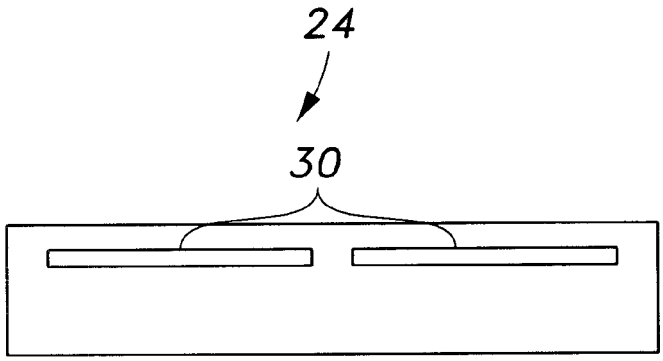
FIG. 5 is an outside elevational view of one short end portion of the frame.
Figure 6:
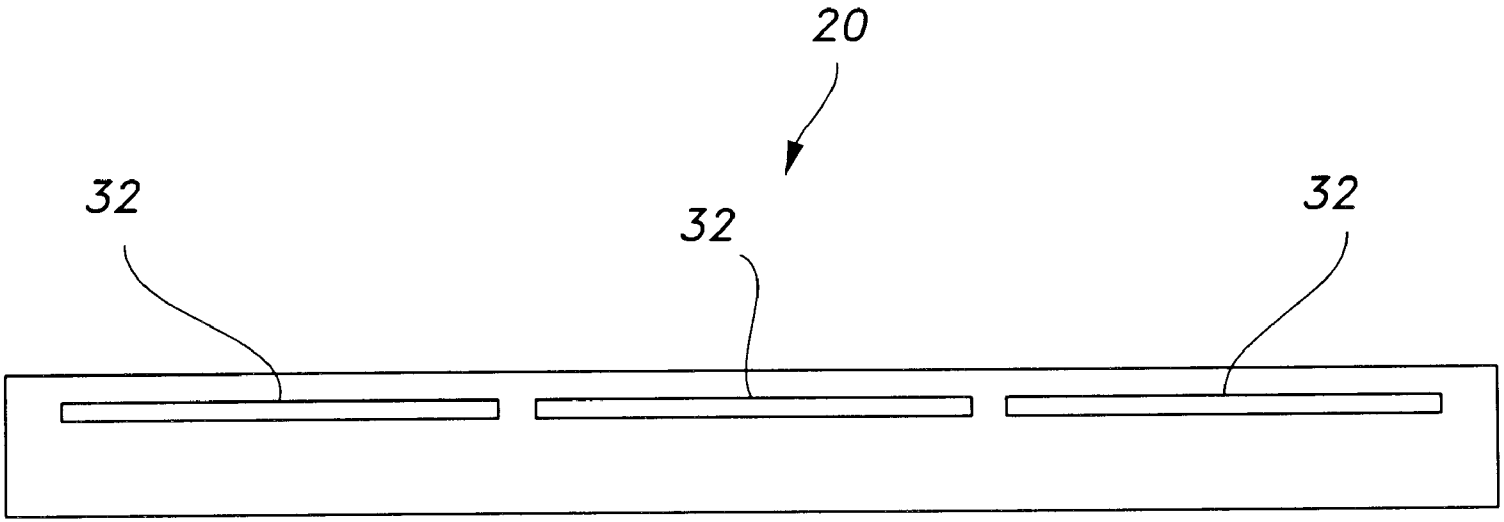
FIG. 6 is an outside elevational side view of one length portion of the frame.

FIG. 1 illustrates a rectangular frame 10 holding a lens 12 attached to an existing light fixture 14 in a room ceiling 16. FIG. 2 depicts a plan view of the rectangular frame 10 showing first length portion 18, second length portion 20, first width portion 22, and second width portion 24. FIG. 3 shows an end view of the first length portion 18 of the frame 10 supporting the lens 12. First cutout 26 and second cutout 28 are formed proximate each opposite end of the first length portion 18 of the frame 10 for securement of any conventional lens 12, and will be amplified in FIG. 7. FIG. 4 depicts the first width portion 22 without any apertures. FIG. 5 shows the second width portion 24 with two horizontal vents 30 for ventilation of the light fixture 14. FIG. 6 illustrates three aligned horizontal vents 32 made in the second length portion 20. Thus, ventilation apertures are provided in only one width portion and one length portion of the frame 10.

Figure 7:
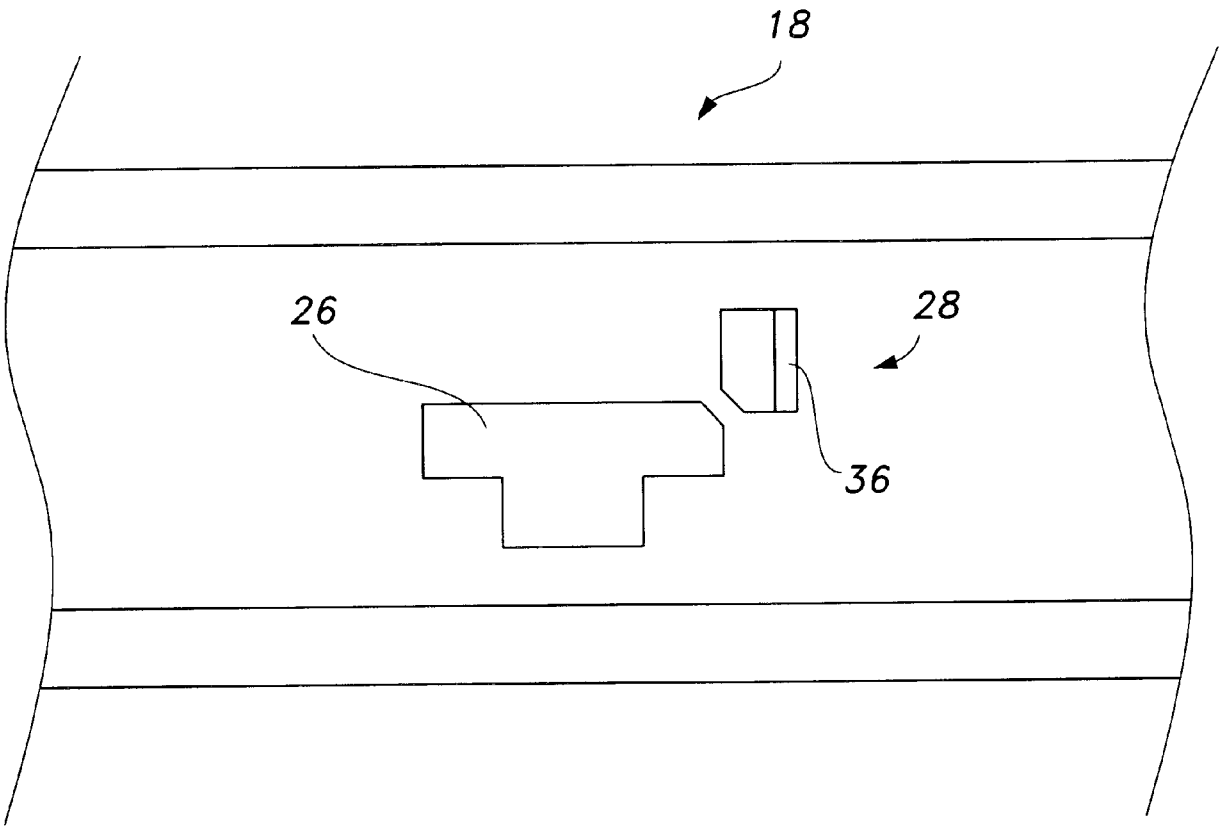
FIG. 7 is a partial elevational view of a corner of the frame.

FIG. 7 shows the first larger cutout 26 in the form of a T to secure the existing conventional hinge (not shown) in the first cutout 26 proximate both ends of the first length portion 18. The second cutout 28 located above and to the side of the first cutout 26 is utilized to secure the lens 10 by cutting out the upper portion 34 and bending in 90° to form a tab 36.

Figure 8:
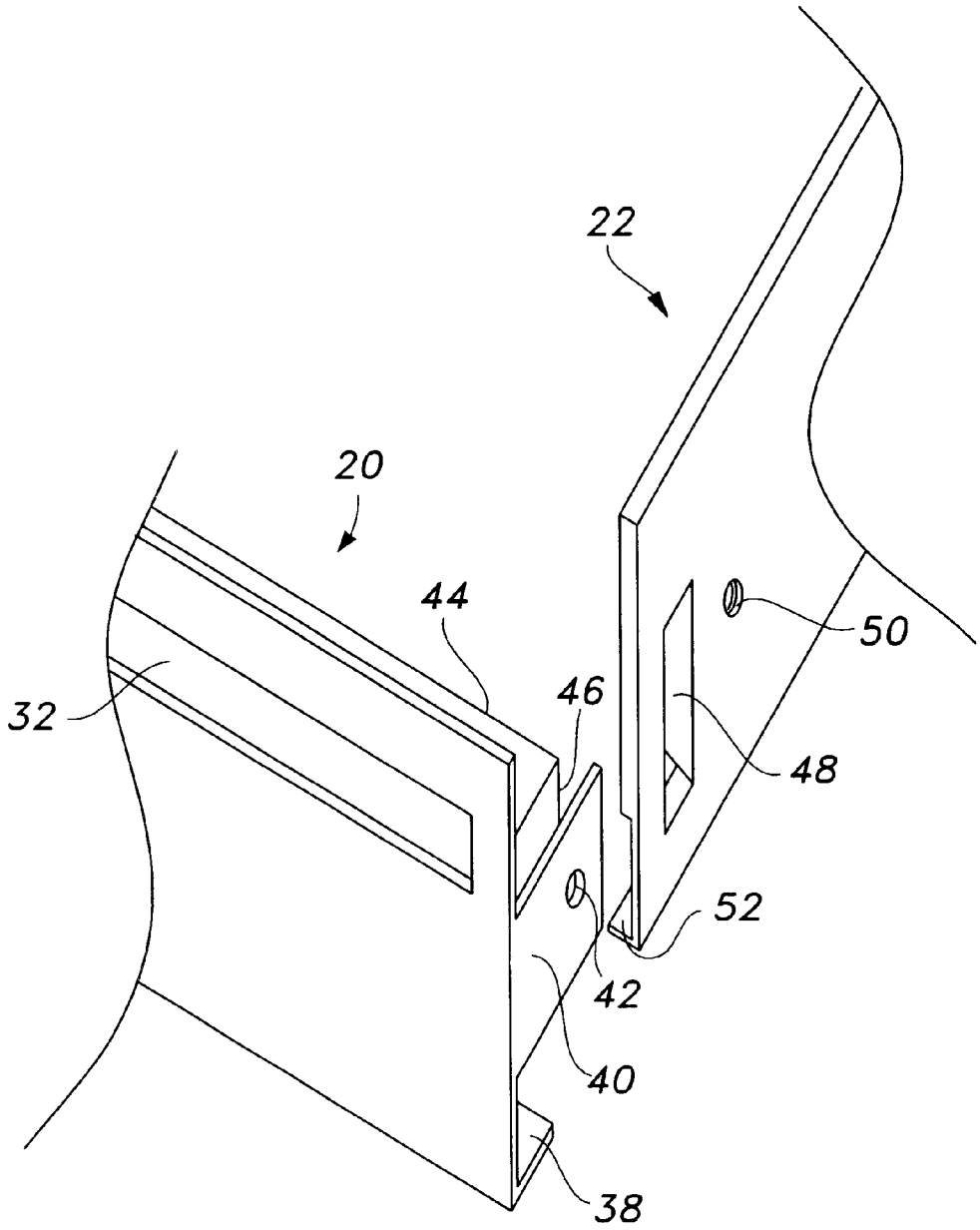
FIG. 8 is a perspective view of an exploded corner joint.

FIG. 8 illustrates a corner detail for joining the four parts of the frame 10. The end portion of the second length portion 20 (on the left) has a base flange 38, a perpendicular lug 40 having an aperture 42, and an inside right-angled ledge portion 44 proximate the top edge having a right-angled flange 46 which ends short of the base flange 38. The first length portion 18 also has the same configuration. The joining end of the first width portion 22 has a rectangular and vertical cutout 48 which is bent inside with a dimple 50 projecting inside to lock the second length portion 20 in place via the aperture 42. The first width portion 22 also has a bottom flange 52. The second width portion 24 also has the same configuration. This corner detail applies to all four corners of the frame 10 to form a frame which will fit conventional light fixtures at the job site.

The use of the invention with conventional ceiling fixtures has resulted in improved lamp life due to the efficient air circulation inherently caused by the vents in the frame.

Thus, it has been shown that the improved frame is efficient, ergonomic and relatively inexpensive compared with the installation of a new housing with vents.

It is to be understood that the present invention is not limited to the embodiment described above, but encompasses any and all embodiments within the scope of the following claims.

I claim:

1. An add-on panel frame for an existing ceiling light fixture having a lens cover, comprising:

first and second parallel length portions;

first and second parallel width portions, said width portions extending between and connecting said length portions to define a generally rectangular framework having an open central area, said framework being dimensioned to fit a ceiling grid opening and configured to support the ceiling light fixture;

means formed proximate each opposing end of said first and second length portions for securing the lens cover of the ceiling light fixture within the open central area of said framework;

fastening means integrally formed at each opposing end of each of said length portions and each of said width portions, for perpendicularly connecting the width portions and the length portions together;

a first series of horizontally aligned vents formed in at least one of said length portions; and a second series of horizontally aligned vents formed in at least one of said width portions;

whereby, the lens cover is removed from the existing ceiling light fixture, the framework is fitted within the ceiling grid opening to support the ceiling light fixture, and the lens cover is then mounted within the framework, thereby allowing air to circulate around the light fixture to provide increased ventilation.

2. The add-on panel frame of claim 1, wherein said fastening means includes a lug having an aperture at each opposing end of each of said length portions and a dimple proximate each opposing end of each of said width portions.

3. The add-on panel frame of claim 1, wherein said securing means include a pair of interiorly bent tabs.

4. The add-on panel frame of claim 1, wherein each of said length and width portions includes a bottom edge having a flange portion extending therefrom.

5. The add-on panel frame of claim 1, wherein said framework is made of a light-weight metal.

* * * * *